US006410501B1

(12) United States Patent
Jones et al.

(10) Patent No.: US 6,410,501 B1
(45) Date of Patent: Jun. 25, 2002

(54) FABRIC CONDITIONING CONCENTRATE

(75) Inventors: Craig Warren Jones; Mansur Sultan Mohammadi, both of Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/625,761

(22) Filed: Jul. 26, 2000

(30) Foreign Application Priority Data

Jul. 26, 1999 (GB) ..... 9917537

(51) Int. Cl.[7] ..... C11D 3/22
(52) U.S. Cl. ..... 510/515; 510/522; 510/527
(58) Field of Search ..... 510/515, 522, 510/527

(56) References Cited

U.S. PATENT DOCUMENTS 5,460,736 A * 10/1995 Trinh et al. ..... 252/8.8

FOREIGN PATENT DOCUMENTS

EP 380406 A2 * 8/1990
WO WO 98/16538 A1 * 4/1998
WO WO 96/19552 A1 * 6/1998

* cited by examiner

*Primary Examiner*—John Hardee

(57) ABSTRACT

A fabric conditioner concentrate is produced comprising a liquid or soft solid derivative of cyclic polyol or a reduced saccharide resulting from 35 to 100% of the hydroxyl groups in the cyclic polyol or reduced saccharide being esterified or etherified, the derivative having at least two or more ether groups independently attached to a $C_8$–$C_{22}$ alkyl or alkenyl chain or mixtures thereof, containing at least 35% tri- or higher esters, an emulsifying agent, a deposition aid and less than 30% by weight water. The nonionic fabric softening component dissolves the deposition aid, which, if it is a cationic deposition aid, can also act as an emulsifying agent, allowing the composition to emulsify easily on mixing with water. Fabric conditioning concentrates according to the present invention maybe in the form of clear isotropic compositions or clear water-in-oil micro-emulsions. The deposition aid allows the nonionic fabric softening component to deposit onto fabric from the emulsion during a rinse step.

Emulsions produced by the present invention give excellent softening and perfume delivery.

15 Claims, No Drawings

FABRIC CONDITIONING CONCENTRATE

TECHNICAL FIELD

The present invention relates to fabric conditioning concentrates with less than 30% by weight of water that easily disperse and self-emulsify on dilution with cold or warm water (10–70° C.) and when emulsified in water give stable emulsions which provide improved softening for laundry.

BACKGROUND AND PRIOR ART

Conventional rinse conditioners are obtained by dispersing a cationic softening material and perfume into hot water. The problem with such conventional aqueous rinse conditioners is that although the rinse conditioners soften laundry they do not deliver perfume onto the fabric well because as much as one third of the perfume in the formulation remains in the rinse water.

EP 829531 discloses a fabric conditioning concentrate comprising a cationic fabric softening compound and oil in which the cationic fabric softening compound is suspended in the oil. When the concentrate is mixed with water, an oil-in-water emulsion is produced, which gives good softening and perfume delivery.

WO 99/43777 discloses a fabric conditioning concentrate composition comprising a fabric softening compound mixed with oil, the composition containing a water-soluble polymeric structurant. This fabric conditioning concentrate easily self-disperses on dilution with cold or warm water and give stable emulsions with controlled viscosity and creaming. It provides excellent perfume delivery and fabric softening quality.

The emulsions produced according from the fabric conditioning concentrates of EP 829531 and WO 99/43777 deliver softening due to the presence of cationic fabric softener, which may be present at a level up to 60% by weight but more normally is in the range 10 by weight to 40% by weight. Typically, the fabric softener is present in these concentrates is in a crystalline state in the liquid oil, giving rise to stability problems. The crystals tend to dissolve above 35–40° C. At low temperatures (below 10° C.) the systems become very viscous, impairing dispersion in water. Separation of crystals from suspension can also occur.

The present inventors have now discovered that fabric conditioning compound concentrates having less than 30% by weight of water can be produced comprising a specified nonionic fabric conditioning in combination with a deposition aid such as a cationic, nonionic or anionic surfactant.

The fabric conditioning concentrate compositions of the present invention self-emulsify or disperse in warm or cold water to provide emulsions. The fabric conditioning emulsions produced provide excellent perfume delivery and fabric conditioning. For example, a high level of absorbency of towels and fabrics softened with the emulsions can be obtained. Ease of ironing benefits and anti-crease benefits are also observed.

The concentrates themselves can be clear or isotropic and have an attractive appearance. They are stable, allowing long term of storage.

DEFINITION OF THE INVENTION

The present invention accordingly provides a fabric conditioning concentrate comprising:

(i) a nonionic fabric softening compound comprising a liquid or soft solid derivative of a cyclic polyol (CPE) or of a reduced saccharide (RSE) resulting from 35 to 100% of the hydroxyl groups in the cyclic polyol or reduced saccharide being esterified or etherified, the derivative (CPE or RSE) having at least 2 or more of ester or ether groups independently attached to a $C_8$–$C_{22}$ alkyl or alkenyl chain or mixtures thereof, and containing at least 35% tri- or higher esters;

(ii) a deposition aid, (iii) an emulsifying agent, and (iv) less than 30% by weight water.

The present invention further provides a method of manufacturing a fabric conditioning concentrate comprising the step of mixing:

(i) a nonionic fabric softening compound comprising a liquid or soft solid derivative of a cyclic polyol (CPE) or of a reduced saccharide (RSE) resulting from 35 to 100% of the hydroxyl groups in the cyclic polyol or reduced saccharide being esterified or etherified, the derivative (CPE or RSE) having at least 2 or more of ester or ether groups independently attached to a $C_8$–$C_{22}$ alkyl or alkenyl chain or mixtures thereof, and containing at least 35% tri- or higher esters;

(ii) a deposition aid, (iii) an emulsifying agent, and (iv) less than 30% by weight water.

The present invention further provides a method of preparing an aqueous emulsion comprising mixing a fabric conditioning concentrate according to the present invention with water.

DETAILED DESCRIPTION OF THE INVENTION

The term "concentrate" in the context of the present invention means that a relatively low level of water is present in the formulation. The maximum level of water that can be present in the formulation is 30% or less by weight of the total formulation, more preferably 20% or less by weight, most preferably 10% or less by weight. In some situations less than 0.5% by weight of water may be present.

The Nonionic Fabric Softening Compound (i)

The concentrate compositions of the present invention comprise a fabric softening compound (i) which is a liquid or soft solid derivative of a cyclic polyol (CPE) or of a reduced saccharide (RSE) resulting from 35 to 100% of the hydroxyl groups in a cyclic polyol or reduced saccharide being esterified or etherified, the derivative having at least two or more ester or ether groups independently attached to a $C_8$–$C_{22}$ alkyl or alkenyl chain or mixtures thereof and containing at least 35% tri or higher esters.

Suitable sugar ester oils are described in international patent application WO 98/16538.

It is preferred if the viscosity of the nonionic fabric softening compound (i) is in the range 5,000 to 20,000 mPas, most preferably 10,000 to 20,000 mPas. All viscosities are measured at 25° C. The nonionic fabric softening compound (i) used in the present invention is substantially Newtonian.

The level of nonionic fabric softening compound (i) in the fabric conditioner concentrate is preferably from 20 to 78 wt % of the composition, more preferably from 40 to 75 wt %, most preferably from 50 to 70 wt %.

The liquid or soft solid (as hereinafter defined) CPEs or RSEs of the present invention result from 35 to 100% of the hydroxyl groups of the starting cyclic polyol or reduced saccharide being esterified or etherified. Typically the CPE's or RSE's have 3 or more ester or ether groups or mixtures thereof for example 4 or more, example 5 or more. It is preferred if two or more of the ester or ether groups of the CPE or RSE are independently of one another attached to a $C_8$ to $C_{22}$ alkyl or alkenyl chain. The $C_8$ to $C_{22}$ alkyl or alkenyl groups may be branched or linear carbon chains.

Preferably 40 to 90% of the hydroxyl groups, most preferably 50 to 80%, e.g. 50 to 70% are esterified or etherified.

CPEs are preferred for use with the present invention. Inositol is a preferred example of a cyclic polyol. Inositol derivatives are especially preferred.

In the context of the present invention the term cyclic polyol encompasses all forms of saccharides. Indeed saccharides are especially preferred for use with this invention. Examples of preferred saccharides for the CPE's or RSE's to be derived from are monosaccharides and disaccharides.

Examples of monosaccharides include xylose, arabinose, galactose, fructose, sorbose and glucose. Glucose is especially preferred.

An example of a reduced saccharide is sorbitan.

Examples of disaccharides include maltose, lactose, cellobiose and sucrose. Sucrose is especially preferred.

The liquid or soft solid CPE's or RSE's of the present invention can be prepared by a variety of methods well known to those skilled in the art. These methods include acylation of the cyclic polyol or reduced saccharide with an acid chloride; trans-esterification of the cyclic polyol or reduced saccharide fatty acid esters using a variety of catalysts; acylation of the cyclic polyol or reduced saccharide with an acid anhydride and acylation of the cyclic polyol or reduced saccharide with a fatty acid. Typical preparations of these martials are disclosed in U.S. Pat. No. 4 386 213 (Procter and Gamble) and AU 14416/88 (Procter and Gamble).

It is preferred if the CPE or RSE has 4 or more ester or ether groups although for some compounds 3 ester or ether groups produce excellent results and are preferred. If the cyclic CPE is a disaccharide it is preferred if the disaccharide has 4 or more ester or ether groups. Particularly preferred CPE's are those with a degree of esterification of 4 or more, for example, sucrose esters.

It is advantageous if the saccharide or reduced saccharide has 3 or more ester groups.

Where the cyclic polyol is a reducing sugar it is advantageous if each ring of the CPE has one ether group, preferably at the C1 position, and the remaining hydroxyl groups are esterified. Suitable examples of such compounds include methyl glucose derivatives.

Examples of suitable CPEs include esters of alkyl(poly) glucosides, in particular alkyl glucoside esters having a degree of polymerisation from 1 to 2.

The liquid or soft solid CPE's or RSE's of the present invention are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the NMR signal with a $T_2$ of less than 100 $\mu$s is considered to be a solid component and any component with $T_{2>100}$ $\mu$s is considered to be a liquid component.

For the CPE's and RSE's the tetra, penta etc prefixes only indicate the average degrees of esterification. The compounds exist as a mixture of materials ranging from the monoester to the fully esterified ester. It is the average degree of esterification which is used herein to define the CPE's and RSE's.

It has been found that CPE's and RSE's having unsaturated or mixed alkyl chain lengths show advantageous results.

Factors governing the suitability of the CPE's and RSE's are the presence and degree of branched chains, mixed chain lengths and the level of unsaturation. Preferred substituents include oleate, linoleate and erucate.

The nonionic fabric softening compound (i) discussed above may have fabric softening properties on its own. However, it will typically only become capable of fabric softening if two conditions are met:

(a) the compound is emulsified, and (b) the compound is deposited onto fabric.

The nonionic fabric softening compounds used in the present invention require an emulsifying agent and a deposition aid.

Emulsifying Agent

The emulsifying agent may be a cationic, nonionic, catanionic, zwitterionic, amphoteric or anionic surfactant.

Catanionic surfactants comprise a complex of a cationic surfactant and an anionic surfactant with the cationic surfactant predominating so that the complex has a net cationic nature.

The emulsifying agent may be a nonionic surfactant, for example an ethoxylated alcohol nonionic surfactant. Preferred nonionic ethoxylated surfactants have an HLB of from about 10 to about 20.

Preferred nonionic emulsifiers are $C_8$–$C_{22}$ alcohol alkoxylates with an average of 3 to 25 alkoxylate groups, more preferably 3 to 10 alkoxylate groups, most preferably 5 to 7 alkoxylate groups. It is advantageous if the surfactant alkyl group contains at least 12 carbon atoms. Typically, the nonionic emulsifier is liquid at ambient temperature. Ethoxylates are the preferred alkoxylates although mixed ethoxylates/propoxylates or propoxylates may also be used.

It has been found that certain cationic compositions suitable for acting as an emulsifying agent can also act as a deposition for the nonionic fabric softening compound. Such cationic deposition aids are discussed below.

Concentrate compositions comprising such cationic deposition aids preferably also comprise a co-emulsifier for rapid dissolution of the concentrate when it is added to water. The co-emulsifier preferably comprises a nonionic surfactant as described above.

Emulsifier is suitably present at a level of 3–40 % more preferably 3–25% by weight of the concentrates, however, co-emsulsifier may be present in the fabric softening concentrates at a level of 1–15% by weight, preferably 2–10% by weight.

The Deposition aid

In the context of the present invention a deposition aid is defined as any material that aids deposition of the selected CPE or RSE onto a fabric during the laundering process.

The deposition aid may be selected from fabric softening compounds, cationic compounds, catanionic surfactants, zwitterionic surfactants or polymeric deposition aids, an amphoteric surfactant (together with a pH modifier) or mixtures thereof. Mixtures of cationic and nonionic compounds are particularly preferred.

It is preferred if the deposition aid is cationic in nature.

If a cationic surfactant or cationic softening aid is not present in the formulation it is preferred if a cationic polymeric deposition aid is present. Most preferably the deposition aid is both cationic in nature and is an emulsifying agent.

Mixtures of deposition aids may be used, for example, a mixture of a cationic surfactant and a nonionic surfactant, or a fabric softening compound and a polymeric deposition aid.

Suitable cationic deposition aids include water soluble single chain quaternary ammonium compounds such as cetyl trimethyl ammonium chloride, cetyl trimethyl ammonium bromide, or any of those listed in European Patent No. 258 923 (Akzo).

Preferably, the deposition aid is a cationic fabric softening compound. Preferably, the cationic deposition aids are quaternary ammonium compounds. It is especially preferred if the cationic deposition aid is a water-insoluble quaternary ammonium material. In particular substantially water insoluble quaternary ammonium materials comprising a single alkyl or alkenyl chain having an average length equal to or greater than $C_{20}$ are preferred. Even more preferable are compounds comprising a polar head group and two alkyl or alkenyl chains each having an average chain length equal to or greater than $C_{14}$.

More preferably each chain has an average chain length greater than $C_{16}$. Most preferably at least 50% of each long chain alkyl or alkenyl group has a chain length of $C_{18}$.

The long chain alkyl or alkenyl groups of the fabric softening deposition aid may be predominantly linear, but it is preferred that they have a substantial degree of branching.

The quaternary ammonium compounds may be alkoxylated, for example ethoxylated or propoxylated, having suitably between 5 and 20 moles of alkoxylation per mole of quaternary ammonium compound.

Quaternary ammonium fabric softening compounds that can be used as deposition aids are also described in WO 98/16538.

Suitable polymeric deposition aids for use with the invention include cationic and nonionic polymeric deposition aids.

Suitable cationic polymeric deposition aids include cationic guar polymers such as Jaguar (ex Rhone Poulenc), cationic cellulose derivatives such as Celquats (ex National Starch), Flocaid (ex National Starch), cationic potato starch such as SoftGel (ex Aralose), cationic polyacrylamides such as PCG (ex Allied Colloids). Cationic polymeric aids are particularly preferred in the absence of any other cationic material in the composition.

When a polymeric deposition aid is used, the concentrate is generally clear though it may occasionally be slightly hazy.

Suitable nonionic deposition aids include Pluronics (ex BASF), dialkyl PEGs, cellulose derivatives as described in GB 213 730 (Unilever), hydroxy ethyl cellulose, starch, and hydrophobically modified nonionic polyols such as Acusol 880/882 (ex Rohm & Haas).

Mixtures of any of the aforementioned deposition aids may be used.

It is preferred that the weight ratio of softening compound to deposition aid is within the range of from 1:10 to 15:1, most preferably within the range 1:5 to 10:1, most preferably 1:2 to 5:1.

The level of deposition aid in the concentrate is preferably from 3 wt % to 40 wt % of the total composition, more preferably from 5 wt % to 20 wt %. The higher levels are preferred when the deposition aid also acts as emulsifying agent.

Preferably, the deposition aid is substantially soluble in the nonionic fabric softening compound (i). This will be discussed further below.

Solvent

It is preferred that the composition contains less than 25 wt % of the total composition of organic solvent, more preferably less than 20 wt %, most preferably less than 10 wt %.

It is especially preferred that the solvent is non-aqueous. In any case level of water must be kept below 30% of the total composition.

A deposition aid comprising a cationic fabric softening compound may be soluble in the nonionic fabric softening compound (i) if, for example, it comprises carbon chains derived from soft tallow, i.e. tallow having a high iodine value. Alternatively, the cationic fabric softening compound may be made soluble in the nonionic fabric softening compound (i) by inclusion of a suitable solvent. Solvents which may be used include ethanol, proponol, isoproponol, ethylene glycol, 1,2 propylene glycol, 1,3-epropylene glycol and glycerol. Suitable solvents preferably have low flash point, for example propylene glycol or hexylene glycol.

The major proportion of the solvent should most preferably be a non-flammable solvent (i.e. have a flashpoint of higher than 25° C.). A mixture of solvents may provide advantageous results, especially with respect to viscosity. In some compositions solvent may be present as a result of being a component of an ingredient of the composition.

Structurant

Optionally, the compositions of the present invention comprise a polymeric water-soluble structurant as disclosed in PCT/EP99/00497.

Inclusion of a polymeric structurant helps to ensure that aqueous emulsions produced using the concentrates of the present invention can have viscosities which are relatively consistent between batches. This is particularly important with emulsions produced by home dilution. The emulsions are not excessively effected by conditions such as local temperature, variations in content of concentrate in the water, salinity or hardness of the dilution water. This allows a consistently attractive product to be produced. Further, the polymeric structurant can assist in giving silky, good quality softened feel to softened fabrics.

A structurant is here defined as a material which increases the viscosity of an aqueous emulsion formed by diluting the concentrate of the invention in water, both at gravitational or zero shear rate and at normal pouring shear rates.

Normal pouring shear rates are in the range 10 to about 110 $s^{-1}$ at 25° C.

Desirably, the viscosity of an emulsion produced by diluting concentrates of the present invention is in the range 40–80 mPa·s at 106 $s^{-1}$, preferably around 60 mPas at 106 $s^{-1}$ at 25° C. It is found that little or no phase separation occurs under these conditions.

Preferably, the structurant will be present in the form of small solid particles in the concentrate composition of the invention. The particles may typically be of size in the range 2–100 micrometres depending on their source. Particle size may be measured by light microscopy. Preferably, the structurant is present as microcrystals.

Upon dilution with water, the polymeric structurant of the invention becomes fully or partially gelatinised.

The term "water-soluble" indicates that the polymeric structurant gelatinises in water at a characteristic temperature range at concentrations of interest, i.e. around 0.1–2% by weight. Preferably, the polymeric structurant when mixed with water does not form a separate phase.

The structurant preferably does not have substantial surfactant properties. The structurant is preferably selected from nonionically or cationically modified natural polymers such as protein or plant derived polymers, particularly polysaccharide compositions such as starch.

As starting material for the manufacture of cationic starch to be used with the present invention, any type of starch can be used such as potato starch, corn starch, wheat starch, tapioca starch or pea starch. The degree of substitution of the cationic starch to be used in accordance with the present invention is preferably in the range 0.005–1 preferably between 0.01 and 0.05. Particularly preferred are forms of starch that have an amylopectin content of more than 95% by weight based on solids.

Suitable methods of manufacturing structurant polymers suitable for use in the present invention are set forth in EP-A-0596580 in the name of Avebe.

Other naturally obtained polymers include cellulose compounds, which may be modified by substituting them with alkyl groups, such as hydrophillically modified hydroxy ethyl cellulose, carboxy methyl cellulose etc. Naturally derived gums such as galactomannan gum or guar gum can be used. Protein derived polymers may include gelatin.

The polymeric structurant used may depend upon the eventual use for which the concentrate is intended. As explained below, the concentrates of the present invention may be used in an industrial or domestic context. Further, the behaviour of some of the concentrates may depend upon the local temperature, hardness of water etc. Cationically modified potato starch such as Solvitose BPN and cationically modified Galactomannan, 2-hydroxypropyl trimethyl ammonium chloride ether (Jaguar C-13-S, C-14-S, C-15, C-17 or C-162—Trade Mark), guar gum or 2 hydroxy-3-(trimethylammonium) propyl ether chloride (HICARE 1000, Registered Trade Mark) and Polygel (Trade Mark) K100 and K200 are preferred for home dilution purposes, when the concentrates may be diluted with a large volume of water, for example to a concentration of fabric softening compound (I) of about 5% wt. In such cases, a structurant is beneficial to provide enhanced viscosity for the emulsion.

As will be described further below the concentrate can be diluted with water under factory conditions. Concentrates suitable for dilution under factory suitably comprise cationic potato starches such as SOFTGEL BDA (Trade Mark), SOFTGEL BD (Trade Mark), AMYLOFAX HS (Trade Mark), RAISAMYL 125 (Trade Mark), RAISAMYL 135 (Trade Mark), RAISAMYL 145 (Trade Mark) and synthetic cationic polyacrylic POLYGEL (Trade Mark) K Series, K100 and K200 (3V Sigma).

The amount of polymeric structurant included in the concentrate of the present invention depends upon the desired concentration of polymeric structurant in the resulting emulsions and on the desired concentration of nonionic fabric softening compound (i) in the emulsion.

Typically, relatively small quantities of polymeric structurant are required in the resulting emulsions to give the desired viscosities. The quantity in the aqueous emulsion is preferably in the range 0.05–2% by weight, more preferably 0.1–1 wt %, most preferably 0.1–0.5% by weight. The concentration of polymeric structurant in the concentrate is suitably in the range 1–10% by weight, more preferably 2–5%, most preferably 3–4% by weight.

Without wishing to be bound by theory, it is believed that the water-soluble polymeric structurant is present in the oil as a suspended phase. When water is present, as discussed below, the polymeric structurant can be dissolved in the aqueous phase.

Perfume

The compositions of the present invention and the method of the present invention are particularly suitable for giving enhanced perfume deposition onto fabric during rinse conditioning. Preferably therefore the concentrate according to the present invention contains perfume suitably at a level in the range 1–10% by weight, preferably 3–6% by weight. Suitable perfume compounds may be selected by the person skilled in the art.

Preferably, the perfume is substantially hydrophobic. Preferably, the perfume is soluble in the nonionic fabric softening compound (i).

Composition pH

The emulsions of the invention when dispersed in water at use concentration preferably have a pH of more than 1.5, more preferably less than 8.

Viscosity Modifier

The concentrates of the present invention may include a viscosity modifier. The viscosity modifier will substantially affect the viscosity of the concentrate composition rather than the emulsion produced from it. The viscosity modifier will also allow the size of emulsion droplets to be reduced and make emulsification easier, leading to products which emulsify easily even using domestic equipment. Viscosity modifier may comprise a solvent as discussed above or a hydrotrope. Suitable viscosity modifiers include ethanol, isopropyl alcohol, hexylene glycol and propylene glycol.

Water

Water can be included in concentrate compositions according to the present invention at levels up to 30% by weight.

If all components of the concentrate composition are dissolved in the nonionic fabric softening component (i) and then water is added slowly at low shear level, a change in the appearance of the composition is observed, from a transparent but slightly hazy appearance to a clear appearance. Without wishing to be bound by theory it is believed that the former appearance is due to the presence of cationic emulsifier/deposition aid dissolved in the fabric softening compound (i), whereas the latter appearance is due to the formation of a continuous phase of nonionic fabric softening compound (i) with, dispersed therein, water micelles of size of the order of nanometers containing dissolved matter, thereby forming a water-in-oil micro emulsion. Such micro-emulsions are found to have superior dispersion and emulsification properties compared to the water free compositions. When these micro-emulsions are diluted with water to form macro-emulsions, the macro-emulsions have higher viscosity than those produced from water free concentrates and hence better resistance to creaming.

The presence of a micro-emulsion can be confirmed by light scattering or conductivity techniques.

Product Form

Concentrates of the present invention are preferably in the form of a high viscosity liquid. The concentrate may be added to water by the consumer or at a factory, to form an emulsion which can then be used immediately or stored for later use. In use the emulsion is added to the rinse liquor in a fabric laundering process.

The concentrates of the present invention are such that they can be placed in the fabric conditioner compartment of a domestic washing machine and emulsified by the rinse water in situ.

Other Ingredients

The concentrates or emulsions of the invention can also contain one or more optional ingredients, selected from pH buffering agents, perfume carriers, fluoresces, colorants, hydrotropes, antifoaming agents, antiredeposition agents, enzymes, optical brightening agents, opacifiers, anti-shrinking agents, anti-wrinkle agents, anti-spotting agents, germicides, fungicides, anti-corrosion agents, drape imparting agents, antistatic agents, silicone oils, mineral oils, ester oils and ironing aids.

Method of Production of Concentrate

The concentrate compositions according to the present invention may be produced according to any suitable method. In a preferred embodiment, all of the components except additional water are mixed together, so that a solution in the nonionic fabric softening compound (i) is formed. In a further, optional step, water can be added slowly and at low shear to produce a clear micro-emulsion as discussed above. It may be necessary to mix the nionionic fabric softening compound (i) with the viscosity modifier before mixing with other ingredients.

Method of Production of Emulsion

According to another aspect of the invention, the concentrate compositions of the present invention can be used to prepare an aqueous emulsion by diluting the concentrate composition with water. Preferably, the concentrate is diluted with ambient or hot water. Preferably the temperature of the dilution water is in the range from ambient to 100° C., preferably 40–70° C., more preferably 50–60° C. for batch dilution. Mixing of the concentrate with water may take place over a time period of 2–30 minutes, depending on the scale of the mixing process, the equipment used etc. The concentrate and water may be agitated in any suitable way, for example stirring or shaking.

The viscosity of emulsions produced according to the present invention may depend upon the conditions under which the emulsion is produced by dilution of fabric conditioning concentrate. Further, when producing an emulsion according to the present invention, there is a danger that an undesirable flocculation of the droplets will occur leading to a creaming and unattractive composition.

The person skilled in the art will be able to avoid such conditions by suitable non-inventive experiments.

However, according to a preferred aspect of the invention, the following procedure may be used to determine the optimum conditions for production of emulsion according to the present invention.

For a given polymeric structurant, experiments may be conducted to gelatinise the polymer in water under controlled conditions of temperature, shear rate and mixing time, whilst measuring the development of viscosity during the mixing process. The optimum shear rate, temperature and mixing time for obtaining maximum polymer viscosity for a given concentration of polymer in the final emulsion can be determined (called 'gelatinisation studies'). Viscosity/shear profile measurements can be made using a Carri-Med (Trade Mark) controlled stress viscometer with cone and plate. The inventor has found that these optimum conditions of temperature, shear rate and processing time can be applied directly to a batch process for diluting according to the invention a fabric conditioning concentrate.

For the preferred range of polymeric structurants, it is found that the optimum batch mixing temperature range is suitably around 40–70° C., more preferably 50–60° C.

During dilution of concentrate by the process of the present invention, water may be added to the concentrate while mixing (phase inversion route) or concentrate may be added to water. The end result will be substantially the same. It is found that droplet size is normally smaller when water is added to concentrate.

The present invention will be further described with reference to the following non-limiting examples.

EXAMPLES

Examples of the invention are denoted by a number and comparative examples are denoted by a letter.

In the following examples, viscosities are measured using a Haake viscometer apparatus.

The performance of fabric softening compositions is assessed by the following techniques.

(i) Softness Test

Softening performance is evaluated by adding to 1 ltr of demineralised water at ambient temperature in a Tergotometer enough product to give 0.1 g of active softener material. The active softener is defined as cationic fabric softener plus nonionic softener (i). In this way, the level of. active softener was equal in the rinse liquor for all examples according to the invention. Three pieces of terry towelling (19 cm×19.5 cm weighing 40 g in total) were added to the Tergotometer pot. The terry towelling was already rinsed in a 0.00045% by weight sodium alkyl benzene sulphonate solution to simulate the anionic of detergent from a main wash. The towels were treated for 5 minutes at 65 rpm, spin-dried to remove excess liquor and line-dried overnight. A panel of 20 trained people evaluated the towels by comparing against set standards. A low number indicates a greater degree of softness (2 is very soft and 8 is harsh).

In order to investigate the consistency of the results, the softness measurement was repeated under the same conditions, to give two results for each composition. Further, for control, an experiment to measure the softening obtained in a parallel experiment with the same source of water was conducted using COMFORT (Trade Mark), a premium conventional fabric conditioner composition.

(ii) Perfume Delivery Evaluation Method

Perfume delivery was evaluated by rinsing in a Tergotometer three pieces of terry towelling (19×19.5 cm weighing 40 g in total) per product in a similar manner to that previously described for softening evaluation above. Instead of being line-dried the cloths were immediately assessed for perfume intensity by a trained group of twenty panellists who ranked each cloth on a scale of zero to five corresponding to descriptors ranging from no perfume to very strong perfume. Further assessments were made after five hours when the cloths were dry and again after twenty-four hours or longer. The level of product was 0.1 g/l active matter with a perfume level in the rinse liquor of 4.76 mg/l.

(iii) Absorbency Test

Absorbency of fabrics was evaluated by treating terry towelling in a Tergotometer with compositions as described for the softening assessment. Strips of fabric were cut to 11 cm by 3 cm. The strips of treated fabric were held vertically and lowered into a dish containing a 0.02% solution of direct red 81 dye, so that ca. 0.5 cm of the fabric was below the surface of the water. The height to which the liquid rose up the strip was measured at intervals of time for a total of one hour. The average height for each treatment was calculated. Higher values are indicative of better absorbency.

Examples 1–9

Fabric conditioning concentrates according to the present invention were prepared by mixing the components listed in Table 1.

TABLE 1

| Example | 1 | 2 | 3 | 4 | 5 | 6 | 7 | 8 | 9 |
|---|---|---|---|---|---|---|---|---|---|
| Nonionic Fabric Softener[1] Ryoto ER290 | 70.0 | 70.0 | 70.0 | 70.0 | 70.0 | 70.0 | 70.0 | 70.0 | 70.0 |
| Emulsifier[2] | | | | | | | | | |
| Ethoquad 0/12 | 19.0 | 19.0 | 15.0 | 19.0 | 19.0 | 19.0 | — | — | — |
| Ethoquad HT25 | — | — | — | — | — | — | 15.8 | — | — |
| DCP 9092-65 | — | — | — | — | — | — | — | 19.0 | — |
| CTAB | — | — | — | — | — | — | — | — | 12.0 |
| Co-emulsifier[3] | | | | | | | | | |
| Synperonic A3 | — | — | — | 3.0 | — | — | — | — | — |
| Tergitol 13-S-7 | — | — | — | — | 3.0 | — | — | — | — |
| Tergitol 13-S-5 | — | — | — | — | — | 3.0 | — | — | — |
| Viscosity modifier | | | | | | | | | |
| Ethanol | 6.4 | — | 4.0 | 3.4 | 3.4 | — | — | — | — |
| Isopropyl alcohol | — | 6.4 | — | — | — | 3.4 | 9.6 | 6.4 | 13.4 |
| Hexylene Glycol | — | — | 6.4 | — | — | — | — | — | — |
| Perfume | 4.6 | 4.6 | 4.6 | 4.6 | 4.6 | 4.6 | 4.6 | 4.6 | 4.6 |
| Softline B53 | | | | | | | | | |

[1]ER290 is a 100% sucrose tetraerucate (ex Mitsubishi-Kagaku Food Cor.)
[2]Ethoquad 0-12 is a 75 wt % active, 25 wt % isopropyl alcohol (ex Akzo Nobel) oleyl bis (2-hydroxyethyl) methylammonium chloride; Ethoquad HT25 is a 95 wt % active with ~5 wt % isopropyl alcohol (ex Akzo Nobel), it is polyoxyethylene (15) tallow methylammonium chloride; DCP 9092-65 is a cationic deflocculating polymer (ex National Starch of 52.6 wt % solids of $C_{13}$ poly DMDAAC cationic headgroup and the rest water as described in EP-A-0415 699; CTAB is 98 wt % active cetyl trimethyl ammonium bromide powder (ex Lancaster).
[3]Synperonic A3 is a polyoxyethylene, thrice ethoxylated synthetic primary $C_{13}/C_{15}$ alcohol (ex ICI), Tergitol 13-S-7 and Tergitol 13-S-5 are a mixture of $C_{11}/C_{15}$ secondary alcohols of 7 and 5 ethylene oxide units anionic emulsifier (ex Union Carbide).

The viscosity of the pure nonionic fabric softener at 25° C. is about 20,000 mPas. When mixed with 12.5 wt % isopropyl alcohol, the viscosity drops to about 70 mPas at 25° C. Table 2 sets out the viscosities measured for Example 1 at varying temperatures and 20 $s^{-1}$. Examples 2–9 have similar viscosities. Examples 1–9 are pourable free-flowing products.

TABLE 2

| Temperature/° C. | 10 | 15 | 20 | 25 | 30 | 35 | 40 |
|---|---|---|---|---|---|---|---|
| Viscosity/mPa · s | 1263 | 1175 | 834 | 667 | 475 | 388 | 344 |

In order to prepare aqueous emulsions, fabric conditioning concentrates according to Examples 1–9 were diluted with water by the following method. 7 g or 21 g of fabric conditioning concentrate were weighed into a bottle, tap water was added to make up a volume of 100 ml and the bottle was shaken to form a milky emulsion. The resulting emulsions comprised 4.8% nonionic fabric softener and 15% nonionic fabric softener respectively. The experiment was repeated with cold (15° C.) and warm (20–30° C.) tap water. Milky, good quality emulsions were formed in each case.

The viscosities of the resulting emulsions were measured and are reported in Table 3.

The viscosities are measured at a shear rate of 20 $s^{-1}$ and are quoted in mpas.

TABLE 3

| Example | 1 | 3 | 4 | 5 | 8 |
|---|---|---|---|---|---|
| 4.8% emulsion | 3.0 | 2.2 | 4.8 | 5.0 | 1.0 |
| 15% emulsion | 163.0 | 31.0 | 84.6 | 32.0 | 3.0 |

The performance of the emulsions produced by the method of the present invention were assessed by measuring softness and perfume delivery as described above. The results are shown in the following Tables 4 and 5.

TABLE 4

| Example | control[1] | 1 | 4 | 5 | 8 | 9 |
|---|---|---|---|---|---|---|
| Softness score[2] | 3.4 | 4.3 | 5.6 | 5.3 | 4.0 | 4.7 |

[1]Comfort (trade mark)
[2]Simulated anionic carry over of 10 ppm (provided by 1 ml of a 1% solution of alkyl benzene sulphonate).

TABLE 5

Comparison of perfume intensities and longevity.

| | wet | dry | |
|---|---|---|---|
| Example | 0 hours | 18 hours | 24 hours |
| No carryover | | | |
| Control | 2.92 | 0.64 | 0.64 |
| Example 1 | 3.74 | 1.58 | 1.29 |
| 10 ppm carryover[1] | | | |
| Control | 3.41 | 0.67 | 0.69 |
| Example 1 | 3.36 | 1.58 | 1.42 |

[1]Simulated anionic carryover = 10 ppm as in Table 4.

To further test the perfume longevity obtainable using emulsions produced by the method of the present invention, towels softened with emulsions produced according to methods of the present invention were compared with a control (Comfort, trade mark). The towels were sent to a panel of 20 people to be tested in their home environment under realistic wash conditions. The towels were scored on a zero to 100 scale basis, 0 being an untreated cloth and 100 the intensity of perfume in the bottle. Table 6 summarises the results.

It can be seen that the emulsions produced using fabric conditioning concentrates according to the present invention achieve excellent softening, perfume delivery and perfume longevity.

TABLE 6

| Example | perfume wet 0 hours | perfume dry 10 hours | 24 hours | 48 hours |
|---|---|---|---|---|
| Towel Monitors | | | | |
| Control | 49.7 | 21.8 | 10.7 | 6.0 |
| Example 1 | 56.8 | 36.6 | 24.0 | 15.0 |
| Polycotton Monitors | | | | |
| Control | 34.0 | 15.0 | 8.6 | 5.5 |
| Example 1 | 39.0 | 22.3 | 13.6 | 8.9 |
| Viscose Monitors | | | | |
| Control | 30.1 | 16.1 | 7.4 | 5.2 |
| Example 1 | 36.0 | 22.6 | 15.3 | 11.0 |

Examples 10–15

The compositions set out in table 7 were prepared by mixing the nonionic fabric softener, emulsifier, coemulsifier, viscosity modifier, perfume and non-softening oil to provide a solution of the components in the non-ionic fabric softener. Subsequently, water as indicated in Table 7 was mixed slowly with the solution in non-ionic fabric softener to prepare clear compositions. Light scattering techniques indicated that these clear compositions comprised water-in-oil micro-emulsions.

In order to test the softening performance of macro-emulsions prepared by diluting the micro-emulsions 10–15, the micro-emulsions were diluted to a level of 5% molar total softening active (defined as the quaternary ammonium emulsifier plus non-ionic fabric softener). 2 grams per liter of the resulting macro-emulsion was used to soften 50 grams of Terry towelling. A simulated carryover of 10 ppm anionic surfactant was provided by adding lmc of a 1% solution of alkyl benzene sulphunate. The softening performance was assessed as set out above. The resulting softness rankings are set out in Table 8. The compositions 10, 12 & 13 were compared to a control comprising a commercial product 'comfort' (trademark).

In order to assess emulsification performance, 90 grams of cold demineralised water was added to 10 grams of micro-emulsion and shaken by hand for 30 seconds. The emulsion was assessed by appearance of the final product. The results are shown in Table 9.

It can be seen that the micro-emulsions of the present invention easily emulsify to give a white milky fluid.

TABLE 7

| Example | 10 | 11 | 12 | 13 | 14 | 15 |
|---|---|---|---|---|---|---|
| Non-ionic fabric softener Ryoto ER290[a] | 18.2 | 36.4 | 55.1 | 18.2 | 55.1 | 65 |
| Emulsifier Rewoquat WE-15[b] | 18 | 18 | 18 | 18 | 18.8 | 13.7 |
| Co-emulsifier Genapol C-050[c] | 5.5 | 7 | 7 | 7 | 5 | 5 |
| Viscosity modifier | | | | | | |
| Propylene glycol | 9.1 | 9.1 | 9.1 | 9.1 | | |
| Hexylene glycol | | | | | 8.9 | 8.9 |
| Perfume Softline B53 | 2.9 | 2.9 | 2.9 | 2.9 | 2.3 | 2.3 |
| Non-Softening oil Estol 1545[d] | 37.5 | 18.6 | 0 | 34.4 | 0 | 0 |
| Demineralized water | 7 | 6 | 5.9 | 8.4 | 7.7 | 6 |

[a]ER 290 is described above
[b]Rewoquat is a dioleyl ester of triethanol ammonium methyl sulphate containing about 10% isopropyl alcohol, the starting parent fatty acid having an iodine value of 8-90 (ex. Witco Corp.)
[c]Genapol C-050 is a C12 alkyl alcohol ethoxylate with approximately 5 moles of ethylene oxide (ex. Clariant) per mole of alcohol.
[d]Estol 1545 is octyl stearate (ex. Unichema)

TABLE 8

| Example | Softness |
|---|---|
| 10 | 5.8 |
| 12 | 4.4 |
| 13 | 5.5 |
| Comfort dilute | 3.3 |

TABLE 9

| Example | Appearance |
|---|---|
| 10 | Easily macro-emulsified to white milky fluid |
| 12 | Easily macro-emulsified to white milky fluid |
| 13 | Easily macro-emulsified to white milky fluid |
| 11 | Easily macro-emulsified to white milky fluid |

Examples 16–26 and A–E

The compositions set out in table 10, below, were prepared by weighing the viscosity modifier and perfume into a bottle and then adding the emulsifer. The mixture was heated slightly to aid dissolution of the emulsifier. The deposition aid (examples 1 to 11) was then added with gentle heating followed by the nonionic softener.

TABLE 10

| Example | A | B | C | D | E | 16 | 17 | 18 | 19 | 20 | 21 | 22 | 23 | 24 | 25 | 26 |
|---|---|---|---|---|---|---|---|---|---|---|---|---|---|---|---|---|
| Nonionic Fabric Softener(1) Ryoto ER290 | 75.0 | 75.0 | 75.0 | 75.0 | 75.0 | 73.5 | 73.5 | 73.5 | 73.5 | 73.5 | 73.5 | 73.5 | 75.0 | 70.0 | 70.0 | 70.0 |
| Anionic Emulsifier(2) | | | | | | | | | | | | | | | | |
| SDS | 12.0 | 7.0 | — | — | — | 12.0 | — | 12.0 | — | 10.5 | — | — | — | — | — | — |
| Na LAS | — | — | 10.0 | — | — | — | 10.0 | — | 10.0 | — | — | — | — | 3.0 | 15.0 | — |
| LAS Acid | — | — | — | 10.0 | — | — | — | — | — | — | 10.0 | — | — | — | — | — |
| Aerosol OT-70 PG | — | — | — | — | 12.0 | — | — | — | — | — | — | 12.0 | — | — | — | — |

TABLE 10-continued

| Example | A | B | C | D | E | 16 | 17 | 18 | 19 | 20 | 21 | 22 | 23 | 24 | 25 | 26 |
|---|---|---|---|---|---|---|---|---|---|---|---|---|---|---|---|---|
| Nonionic Emulsifier[3] | | | | | | | | | | | | | | | | |
| Tergitol 15-S-7 | — | 3.0 | — | — | — | — | — | — | — | — | — | — | 10.0 | 12.0 | — | 9.0 |
| Synperonic A7 | — | — | — | — | — | — | — | — | — | — | — | — | — | — | — | — |
| Viscosity Modifier | | | | | | | | | | | | | | | | |
| IPA | 8.4 | — | 10.4 | 5.0 | 8.4 | 8.4 | 8.4 | 8.4 | 12.4 | — | 0.5 | 8.4 | 8.4 | 8.4 | 8.4 | 8.4 |
| Ethanol | — | 10.4 | — | 5.4 | — | — | — | — | — | — | — | — | — | — | — | — |
| Deposition aid[4] | | | | | | | | | | | | | | | | |
| Jaguar C13-5 | — | — | — | — | — | 1.5 | — | — | — | — | — | 1.5 | 1.5 | 1.5 | 1.5 | 1.5 |
| Jaguar C162 | — | — | — | — | — | — | 1.5 | — | — | — | — | — | — | — | — | — |
| Ucare JR125 | — | — | — | — | — | — | — | 1.5 | — | — | — | — | — | — | — | — |
| Ucare JR400 | — | — | — | — | — | — | — | — | 1.5 | — | — | — | — | — | — | — |
| APOMUL SAK | — | — | — | — | — | — | — | — | — | 11.4 | 11.4 | — | — | — | — | — |
| Perfume | 4.6 | 4.6 | 4.6 | 4.6 | 4.6 | 4.6 | 4.6 | 4.6 | 4.6 | 4.6 | 4.6 | 4.6 | 4.6 | 4.6 | 4.6 | 4.6 |

In order to prepare emulsions of examples 16–26 and A–E, 6 g and 20 g of each example was placed in a bottle. 94 g and 80 g, respectively, of demineralised water at room temperature were then added to the bottle and the bottle was shaken. This gave products with active (i.e. nonionic softener) concentrations of 4.8 wt % and 15 wt % respectively. The ease with which some of the emulsions were formed is reported in table 11. In the following table, "B", "P", "A" and "G" denote bad, poor, acceptable and good respectively.

TABLE 11

| Example | 4.8 wt % active | 15 wt % active |
|---|---|---|
| A | P | B |
| C | B | P |
| 18 | A | A |
| 23 | A | G |
| 25 | A | A |
| 26 | G | G |

The performance of the emulsions was evaluated by measuring softness performance and absorbency and rewetting performance.

Softness Performance

In the following test, the emulsions comprising 15 wt % active were used. The samples were prepared according to the method used in the softness test described hereinabove (see "(i) softness test") except that the terry towelling had been rinsed in either 0, 1 ml, 3 ml or 5 ml of a 1% sodium alkyl benzene sulphonate solution (instead of 0.00045% by weight ABS) in order to simulate anionic carry-over. The results are given in table 12. The result outside the brackets represents the softness score where 8 is harsh and 2 is very soft. The result within the brackets is the number of panellists expressing a preference in a paired comparison test. Higher numbers representing greater preference.

TABLE 12

| Carryover level[1] | Control[2] | Example 16 | Example 23 | Example C |
|---|---|---|---|---|
| 0 | 4.13 (14) | 4.50 (8) | 4.73 (11) | 5.88 (4) |
| 1 | 3.83 (12) | 5.50 (9) | 5.00 (14) | 6.00 (2) |

TABLE 12-continued

| Carryover level[1] | Control[2] | Example 16 | Example 23 | Example C |
|---|---|---|---|---|
| 3 | 4.00 (15) | 5.33 (12) | 5.33 (9) | 5.83 (1) |
| 5 | 5.50 (11) | 5.17 (12) | 4.83 (11) | 6.00 (1) |

[1]ml of a 1% sodium alkyl benzene sulphonate solution.
[2]Comfort (trade mark) bought in UK June 1999 as a concentrate.

The results show that the examples of the invention provide significantly better softening than the comparative example across all levels of carryover. This is confirmed by the paired-comparison results which show a significant preference for fabric treated using the compositions of examples 1 and 8 over example C.

Absorbency and rewetting Test

The absorbency of fabrics was evaluated according to the method described hereinabove (see "(iii) absorbency test"). The height represents the average height of water raised up 3 cloths. The % rewettability is the average height raised divided by the average overall height of the cloths. The results are given in table 13.

TABLE 13

| Example | 16 | 20 | 23 | 24 | 25 | 26 | C |
|---|---|---|---|---|---|---|---|
| Height, cm[2] | 13.8 | 13.3 | 15.5 | 14.5 | 15.5 | 15.5 | 14.0 |
| % Rewetting[2] | 89.0 | 86.0 | 100.0 | 93.5 | 100.0 | 100.0 | 90.3 |
| Height, cm[3] | 14.2 | 15.3 | 15.5 | 15.3 | 15.5 | 14.7 | 15.0 |
| % Rewetting[3] | 91.4 | 98.9 | 100.0 | 98.9 | 100.0 | 94.6 | 96.8 |

[2]height and % rewetting of fabric not treated with sodium alkyl benzene sulphonate solution.
[3]height and % rewetting of fabric treated with 5 ml of 1% sodium ABS to simulate anionic carryover.

Perfume Evaluation

Perfume was evaluated according to the method described in "(ii) Perfume Delivery Evaluation Method" above. The results are given in table 14. ○ represents no perfume and 5 represents very strong perfume.

TABLE 14

| Time | 0 (wet) | 5 hours | 24 hours | 48 hours | 0 (wet) | 5 hours | 24 hours | 48 hours |
|---|---|---|---|---|---|---|---|---|
| Carryover[1] | 0 | 0 | 0 | 0 | 5 | 5 | 5 | 5 |
| Control[2] | 3.30 | 1.64 | 0.74 | 0.76 | 2.83 | 1.33 | 0.57 | 0.61 |
| Example 16 | 3.42 | 2.54 | 1.45 | 0.79 | 3.28 | 2.67 | 1.26 | 0.75 |
| Example 24 | 3.82 | 2.77 | 1.33 | 0.82 | 3.22 | 2.50 | 1.19 | 0.69 |
| Example 26 | 3.48 | 2.72 | 1.38 | 0.91 | 3.67 | 2.33 | 1.31 | 0.78 |

[1]ml of a 1% solution of ABS.
[2]Comfort (trade mark).

The present invention has been described above by way of example only and modifications can be made within the invention.

What is claimed is:

1. A fabric conditioning concentrate comprising:

i) 20 to 78 weight percent of a nonionic fabric conditioning compound comprising a liquid or soft solid derivative of a cyclic polyol (CPE) or of a reduced saccharide (RSE) resulting from 35 to 100% of the hydroxyl groups in the cyclic polyol or reduced saccharide being esterified or etherified, the derivative (CPE or RSE) having at least 2 or more of ester or ether groups independently attached to a $C_8$–$C_{22}$ alkyl or alkenyl chain or mixtures thereof, and containing at least 35% tri or higher esters;

ii) a deposition aid, iii) an emulsifying agent, and iv) less than 30% by weight water.

2. A fabric softening composition according to claim 1 wherein the CPE or RSE results from a cyclic polyol or a reduced saccharide having 40–70% of the hydroxyl groups esterified and/or etherified.

3. A fabric conditioning concentrate composition according to claim 1 in which CPE or RSE is derived from a monosaccharide or disaccharide.

4. A fabric conditioning concentrate composition according to claim 1 wherein the CPE is selected from sucrose pentaoleate, sucrose tetraoleate, sucrose pentaeuracate and sucrose tetraerucate.

5. A fabric conditioning concentrate composition according to claim 1 in which the emulsifying agent is selected from a cationic surfactant, a nonionic surfactant, an anionic surfactant, a zwitterionic surfactant, a catanionic surfactant, an amphoteric surfactant or mixtures thereof.

6. A fabric conditioning concentrate composition according to claim 1 in which the deposition aid is selected from a cationic surfactant, a nonionic surfactant, a catanionic surfactant, an anionic surfactant,a zwitterionic surfactant a polymeric deposition aid, a fabric softening compound, an amphoteric surfactant (together with a pH modifier) or mixtures thereof.

7. A fabric conditioning concentrate composition according to claim 6 in which the deposition aid is a quaternary ammonium compound and acts as an emulsifying agent.

8. A fabric conditioning concentrate composition according to claim 1 in which the ratio of CPE or RSE to deposition aid is within the range from 1:1 to 15:1.

9. A fabric conditioning concentrate composition according to claim 1, wherein the quantity of component (i) is in the range 30–78 weight percent.

10. A fabric conditioning concentrate composition according to claim 1, wherein the quantity of component (ii) is less than 25% by weight based upon the concentrate composition.

11. A fabric conditioning concentrate according to claim 1 in which the ratio of (i) to (ii) is in the range 1:1 to 5:1.

12. A fabric conditioning concentrate composition according to claim 1 which further comprises a viscosity control agent.

13. A fabric conditioning concentrate composition according to claim 1 in the form of a water-in-oil micro-emulsion or an isotropic composition.

14. A method of manufacturing a fabric conditioning concentrate according to any preceding claim comprising the step of mixing:

i) 20 to 78 weight percent of a nonionic fabric conditioning compound comprising a liquid or soft solid derivative of a cyclic polyol (CPE) or of a reduced saccharide (RSE) resulting from 35 to 100% of the hydroxyl groups in the cyclic polyol or reduced saccharide being esterified or etherified, the derivative (CPE or RSE) having at least 2 or more of ester or ether groups independently attached to a $C_8$–$C_{22}$ alkyl or alkenyl chain or mixtures thereof, and containing at least 35% tri or higher esters;

ii) a deposition aid, iii) an emulsifying agent, and iv) less than 30% by weight water.

15. A method of preparing an aqueous emulsion comprising mixing a fabric conditioning concentrate according to claim 1 with water.

* * * * *

UNITED STATES PATENT AND TRADEMARK OFFICE

CERTIFICATE OF CORRECTION

PATENT NO. : 6,410,501 B1
DATED : June 25, 2002
INVENTOR(S) : Jones et al.

It is certified that error appears in the above-identified patent and that said Letters Patent is hereby corrected as shown below:

Column 15,
Line 20, insert
-- (1) Ryoto ER290 is described above (2) SDS is sodium dodecyl sulphate (ex Fisher Chemicals)
Na LAS is sodium lauryl alkyl sulphate (ex ICI)
LAS acid is lauryl alkyl sulphuric acid (ex ICI)

(3) Tergitol 15–S–7 is $C_{11-15}$ secondary alcohol with 7 ethylene oxide units (ex Union Carbide)
Synperonic A7 is a synthetic primary $C_{13-15}$ alcohol with 7 ethylene oxide units (ex ICI)

(4) Jaguar C13–5 is 2 hydropropyl trimethyl ammonium chloride ether (ex Rhodia)
Jaguar C162 is a cationic guar gum (ex Rhodia)
Ucare JR125 is a cationic cellulose (ex Union Carbide)
Ucare J400 is a cationic cellulose (ex Union Carbide)
Apomul SAK is azetidinium polyamidoamide (ex Stevenson) --

Signed and Sealed this

First Day of October, 2002

*Attest:*

*Attesting Officer*

JAMES E. ROGAN
*Director of the United States Patent and Trademark Office*